US007219900B2

(12) United States Patent
Meibock

(10) Patent No.: US 7,219,900 B2
(45) Date of Patent: May 22, 2007

(54) APPARATUS, SYSTEM, AND METHOD FOR UNIBODY SKATE BOOT

(75) Inventor: Antonin A. Meibock, Calgary (CA)

(73) Assignee: Kor Hockey, Ltd, Alberta (CA)

( * ) Notice: Subject to any disclaimer, the term of this patent is extended or adjusted under 35 U.S.C. 154(b) by 227 days.

(21) Appl. No.: 10/729,879

(22) Filed: Dec. 5, 2003

(65) Prior Publication Data

US 2004/0168357 A1 Sep. 2, 2004

Related U.S. Application Data

(60) Provisional application No. 60/443,449, filed on Jan. 28, 2003.

(51) Int. Cl.
*A63C 1/40* (2006.01)

(52) U.S. Cl. ..... 280/11.27; 280/11.12; 36/115

(58) Field of Classification Search ..... 280/11.12, 280/11.14, 11.19, 11.221, 11.223, 11.225, 280/11.231, 11.27, 11.28; 36/89, 93, 115
See application file for complete search history.

(56) References Cited

U.S. PATENT DOCUMENTS 3,659,361 A * 5/1972 White, Sr. ..... 36/89
3,934,892 A * 1/1976 Baikie ..... 280/11.12
3,958,291 A * 5/1976 Spier ..... 12/142 RS
4,245,410 A * 1/1981 Molitor ..... 36/117.1
4,509,276 A 4/1985 Bourque
4,638,578 A * 1/1987 Eiteljorg, II ..... 36/117.9
4,825,566 A * 5/1989 Sartor ..... 36/117.8
4,826,183 A 5/1989 Bratland et al.
5,164,240 A 11/1992 Burgess
5,171,033 A * 12/1992 Olson et al. ..... 280/11.202
5,342,070 A * 8/1994 Miller et al. ..... 280/11.231
5,390,430 A 2/1995 Fitchmun et al.
5,401,564 A 3/1995 Lee et al.
5,462,295 A * 10/1995 Seltzer ..... 280/11.19
5,498,033 A * 3/1996 Hoshizaki et al. ..... 280/841
5,678,330 A * 10/1997 Van Dyke et al. ..... 36/89
5,913,593 A 6/1999 Aird et al.
5,924,706 A * 7/1999 Seltzer et al. ..... 280/11.31
5,940,991 A 8/1999 Cabalquinto
6,079,128 A 6/2000 Hoshizaki et al.
6,112,434 A * 9/2000 Seltzer et al. ..... 36/115
6,168,172 B1 * 1/2001 Meibock et al. ..... 280/11.221
6,223,457 B1 * 5/2001 Graf ..... 36/115
6,233,848 B1 * 5/2001 Bonaventure ..... 36/89
6,260,290 B1 7/2001 Chenervert
6,295,679 B1 10/2001 Chenervert
6,499,233 B1 12/2002 Chenervert
6,505,422 B2 1/2003 Racine (Continued)

FOREIGN PATENT DOCUMENTS

WO PCT/EP98/03902 6/1998

*Primary Examiner*—Jeff Restifo
(74) *Attorney, Agent, or Firm*—Black Lowe & Graham, PLLC

(57) ABSTRACT

Skate boot apparatuses, a skate, and a method are provided. A base including an upper face configured to receive a wearer's foot and a lower face configured to structurally support a skate mechanism is provided. An integral upper support is provided, the integral upper support extending upwardly from the base to a point above an ankle of the wearer, the integral support having a varying rigidity decreasing from a high rigidity near the base to a low rigidity near the point above the ankle of the wearer.

115 Claims, 7 Drawing Sheets

U.S. PATENT DOCUMENTS 6,550,159 B1 * 4/2003 Madore ..... 36/115
6,647,576 B2 11/2003 Racine
6,663,116 B2 * 12/2003 Evans ..... 280/11.225
6,739,077 B2 * 5/2004 Morgan ..... 36/115
6,775,932 B2 * 8/2004 Lin ..... 36/136
6,792,700 B2 * 9/2004 Gallegos ..... 36/89
6,871,424 B2 * 3/2005 Labonte et al. ..... 36/115

* cited by examiner

APPARATUS, SYSTEM, AND METHOD FOR UNIBODY SKATE BOOT

PRIORITY CLAIM

This invention claims priority from U.S. Provisional Application No. 60/443,449, filed Jan. 28, 2003.

FIELD OF THE INVENTION

This invention relates generally to skates and, more specifically, to skate boot construction.

BACKGROUND OF THE INVENTION

Design of skate boots, particularly for hockey skates, has changed little over the course of the last century. In the early twentieth century, future Hall of Fame hockey star Joe Hall realized that his hockey skates were not as responsive or supportive as he would have wanted them to be. Mr. Hall approached a neighbor, a shoemaker from Brandon, Manitoba, named George Tackaberry, to try to develop improved hockey skates. Mr. Tackaberry developed the concept of a custom leather boot featuring a reinforced toe and heel to provide the skater with better support and control. These were the first legendary "Tacks" skates, which have since become the de facto standard for all hockey skates.

However, since Mr. Tackaberry's development of his skates, little progress has been made. This is unfortunate in light of the increasing needs of skaters. Figure skating, speed skating, and ice hockey, have become increasingly popular. As hockey becomes more popular, better, faster, stronger and larger athletes are playing hockey, and these athletes seek increasingly better equipment to attain every possible advantage in competition. As a result, more responsive and supportive skates are desired.

FIG. 1 shows a conventional skate 100 which, in this example, is a hockey skate. A conventional skate 100 generally includes three sections: a skate mechanism 102, an upper 104, and a base 106 coupling the skate mechanism 102 to the upper 104. The skate mechanism 102, in this case, includes a blade 110, a skate frame 112 configured to support the blade 110 with a plurality of pylons 113, and a mounting bracket 114 configured to join the skate mechanism 102 to the base 106. Alternatively, in an in-line, wheeled skate (not shown), the skate mechanism includes the wheels, a frame configured to support the wheels, and a bracket configured to join the mechanism to the base.

The base 106, which is analogous to the sole of a shoe, is joined with the mounting bracket 114 using rivets or similar fasteners (not shown). The upper 104, which is analogous to the upper of a shoe, in most skates is formed from a combination of fabric and leather and nailed, stitched, and/or glued to a last board (not shown in FIG. 1), just as the upper of a shoe is attached to its last board. Alternatively, the upper 104 is molded from plastic and glued or molded to the last board. Edges of the upper 104 are attached around edges of an underside of the last board. The last board is coupled to the base 106 to complete the boot.

Conventional skate designs, such as the skate 100, result in a number of shortcomings. One such shortcoming results from attachment of the skate mechanism 102 to the base 106 and subsequent attachment of the base 106 to the upper 104. The conventional joining of these separate sections 102, 104, and 106 results in a potentially undesirable degree of play between the wearer's foot and the skate mechanism 102 as the upper 104 flexes around the wearer's foot (not shown), the base 106 flexes against the upper 104, and the mounting bracket 114 of the skate mechanism 102 flexes against the base 106. Although some speed skates incorporate a linear array inserts into their bases, such a linear array does not provide a desirable degree of support for lateral movement. As a result of the joining of these separate structures, the responsiveness of the skate 100 to movements of the wearer is diminished.

FIG. 2 shows a cutaway view 200 of a conventional skate 100 and visually highlights the layers interposed between the wearer and the skate mechanism 102. The cutaway view 200 shows how the upper 104 is fastened to the last board 210 only around the edges of the last board 210. Limited attachment of the upper 104 to the last board 210 adds to unwanted flexure between the upper 104 and the last board 210, which can result in attenuation of the wearer's movements to the skate mechanism 102. A contoured footbed 220 supports the foot of the user. The footbed 220 may be joined to the last board 210, but the two are nonetheless separate and may result in some further attenuation between the movements made by the wearer and the response of the skate mechanism 102. However, without the footbed 220, the wearer's foot could rub uncomfortably over attachments between the base 106 and the skate bracket 112. Generally, comfort and responsiveness are traded off in conventional skate design.

Another shortcoming results from a tradeoff between comfort and responsiveness. The upper 104 of a newly manufactured skate 100, like the upper of a new manufactured shoe, may be rigid and uncomfortable, but softens and conforms over time to better fit the wearer's ankle and foot. The initial rigidity may be somewhat uncomfortable to the wearer, although it simultaneously may afford greater responsiveness between the wearer's foot and the skate. After a break-in period—which may be a lengthy and unpleasant process—lessens the rigidity of the upper 104, the upper 104 may be more comfortable, but may be correspondingly less responsive to the movements of the wearer. Unfortunately, the more thoroughly broken-in the skate 100 becomes, the more pliable the entire skate 100 becomes. Thus, over time the skate 100 may become more comfortable, but it also may become less responsive. Conventional molded uppers formed from plastic do not break-in with time, thus the material used generally is partially pliable or semi-rigid to provide a tradeoff between comfort and control.

Thus, there are unmet needs in the art for a skate that optimally combines comfort and responsiveness, reduces or eliminates the break-in period, and betters maintains structural integrity over time.

SUMMARY OF THE INVENTION

Embodiments of the present invention provide a skate boot, a skate using the improved unibody boot, and a method for making the skate boot. The boot provides an integrated base and upper directly couplable to a skate mechanism, resulting in a more rigid, supportive, and responsive skate. The upper of the skate is molded of at least a partially rigid material to comfortably yet securely conform to a shape of a wearer's foot and ankle to better transfer the wearer's movements to the skate. Contouring of the upper also reduces a break-in period over which the upper becomes more comfortable to wear.

More particularly, the present invention comprises skate boot apparatuses, a skate, and a method. A base including an upper face configured to receive a wearer's foot and a lower face configured to structurally support a skate mechanism is provided. An integral upper support is provided, the integral upper support extending upwardly from the base to a point above an ankle of the wearer, the integral support having a varying rigidity decreasing from a high rigidity near the base to a low rigidity near the point above the ankle of the wearer.

In accordance with further aspects of the invention, a plurality of inserts is included in the boot. In one embodiment of the present invention, the inserts are arrayed around circumferential edges of the base. The inserts are configured to engage a plurality of skate attachment devices to couple the skate mechanism to the boot. The inserts are integrated with the base and configured to engage the skate attachment devices through the shaped lower surface of the unibody boot. In one embodiment, the base is molded to at least partially encompass the inserts.

In accordance with another aspect of the present invention, at least one of the inserts includes an inwardly threaded female connector configured to receive one of the skate attachment devices, the skate attachment device including an outwardly threaded male connector. Alternatively, at least one of the inserts includes an outwardly threaded male connector configured to engage one of the skate attachment devices, the skate attachment device including an inwardly threaded female connector.

In accordance with other aspects of the present invention, at least one integral lug extends generally downwardly from the base to engage the skate mechanism. The integral lug includes at least one attachment point extending through the integral lug in a direction generally parallel to the lower face of the base, the attachment point being configured to receive a skate attachment device. In one embodiment of the present invention, the integral lug is configured to interleavably engage a recess in a skate mechanism.

Further, the base may include a core section. The core section may include a rigid foam material. The core section suitably is fixably molded within the boot or injection molded into a recess formed within the boot. The core section may include a rigid foam material. The core section may include a plurality of recesses to accommodate inserts coupled with the base, the inserts having protrusions extending into an interior of the boot. Alternatively, the core section is formed separately from the boot and received into a core section recess formed in the boot. The core section may be custom formed to accommodate the wearer's foot. The core section suitably is bonded to the upper surface of the base of the boot.

In accordance with other aspects of the present invention, the boot includes a range of rigidities including a first rigidity proximate to the shaped lower surface and a second rigidity away from the shaped lower surface, the first rigidity being greater than the second rigidity. The boot may be formed by at least one of joining a plurality of layers or by molding.

A varying rigidity of the boot ranging from the first rigidity to the second rigidity is created by using a varying number of the layers. Sections of the boot having a high rigidity include a first number of the layers and sections of the boot having the low rigidity include a second number of the layers where the first number is greater than the second number. Also, the varying rigidity of the boot suitably is created by using layers including layers of varying compositions, each of the varying compositions having varying rigidities.

Also in accordance with aspects of the present invention, the layers may include at least one hingably coupled layer, the hingably coupled layer being partially joined with the boot toward the base and being partially unjoined with the boot away from the base such that the hingably coupled layer is movable at an upper end configured to receive the wearer's ankle.

According to other aspects of the present invention, the layers include at least one of a long-woven fiber material. The long-woven fiber material may include one of a fiberglass, a carbon-fiber, and an aramid fiber, such as KEVLAR. Also, at least one of the layers may include an impact-resistant material, such as a polyurethane plastic. The layer of impact-resistance material suitably may be an outermost layer of the boot. The layer may be transparent, and disposed to at least partially protect a graphical design disposed beneath an outer surface of the layer of impact-resistant material. The graphical design may be sublimated on a non-outward-facing side of the layer.

In accordance with other aspects of the present invention, the varying rigidity of the boot is created by molding using a varying thickness wherein sections of the boot having a high rigidity include a first thickness and sections of the boot having the low rigidity include a second thickness where the first thickness is greater than the second thickness. Also, the varying rigidity of the boot is created by molding using a material of varying rigidity wherein sections of the boot having a high rigidity include a first material and sections of the boot having the low rigidity include a second material where the first material is more rigid than the second material. Suitably, at least one of the first material and the second material includes a short fiber material. The rigidity of the short fiber material is increasable by increasing a fiber concentration in the short fiber material.

In accordance with still further aspects of the present invention, the upper support is configured to extend generally over a metatarsal of the wearer's foot. The upper support may be configured to receive a toe cap, with the upper support being configured to at least partially extend over a trailing edge of the toe cap. The upper face of the base may include a recess for receiving an edge of a toe cap.

Lastly, in accordance with other aspects of the present invention, at least one of the base and the upper support include a ventilation opening extending through the upper support.

BRIEF DESCRIPTION OF THE DRAWINGS

The preferred and alternative embodiments of the present invention are described in detail below with reference to the following drawings.

DETAILED DESCRIPTION OF THE INVENTION

By way of overview, the present invention comprises skate boot apparatuses, a skate, and a method. A base including an upper face configured to receive a wearer's foot and a lower face configured to structurally support a skate mechanism is provided. An integral upper support is provided, the integral upper support extending upwardly from the base to a point above an ankle of the wearer, the integral support having a varying rigidity decreasing from a high rigidity near the base to a low rigidity near the point above the ankle of the wearer.

Figure 3:
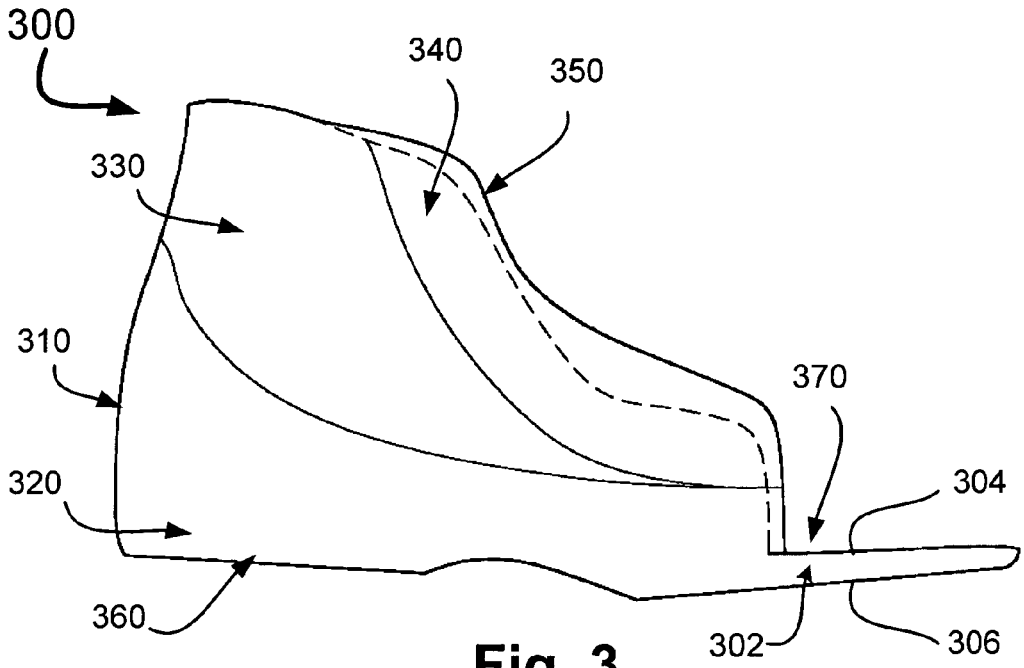
FIG. 3 is a side elevational view of a skate boot according to an embodiment of the present invention.

FIG. 3 is a side elevational view of a boot 300 according to an embodiment of the present invention. As will be further described below, the boot 300 may be constructed a variety of different ways. Using any one of these ways to construct the boot 300, generally the resulting boot 300 effectively is a one-piece shell to provide structural rigidity to allow more improved control and responsiveness of a skate using the boot 300.

Figure 1:
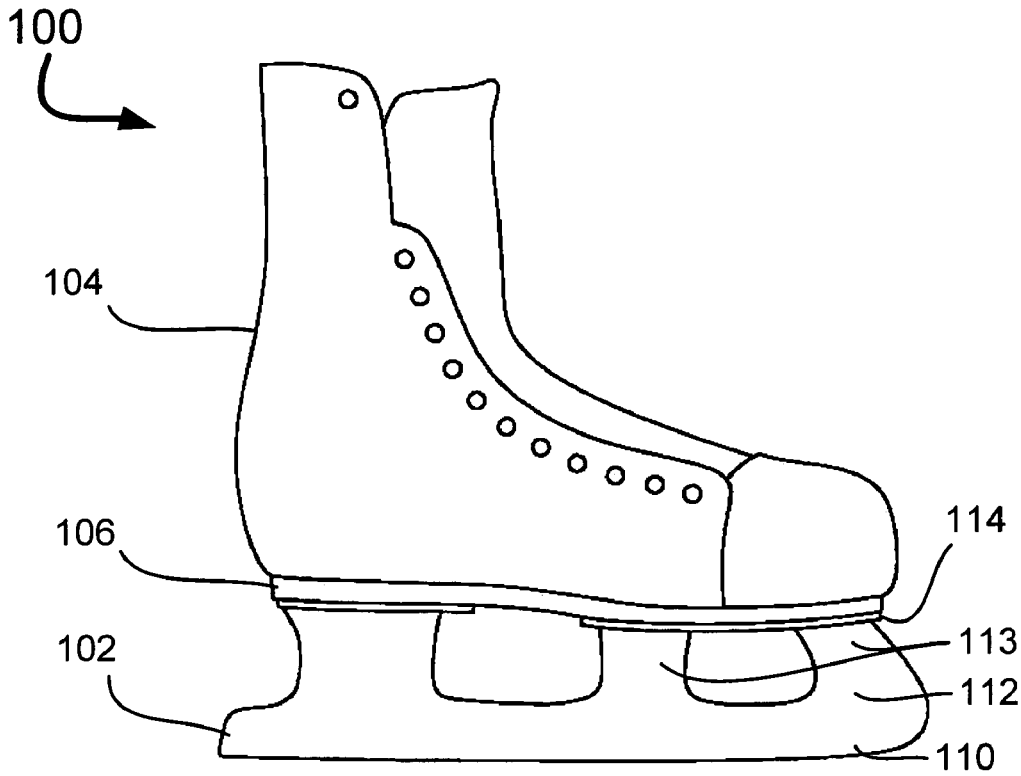
Fig. 1 (Prior Art)
FIG. 1 is a side elevational view of a conventional hockey skate.
Figure 2:
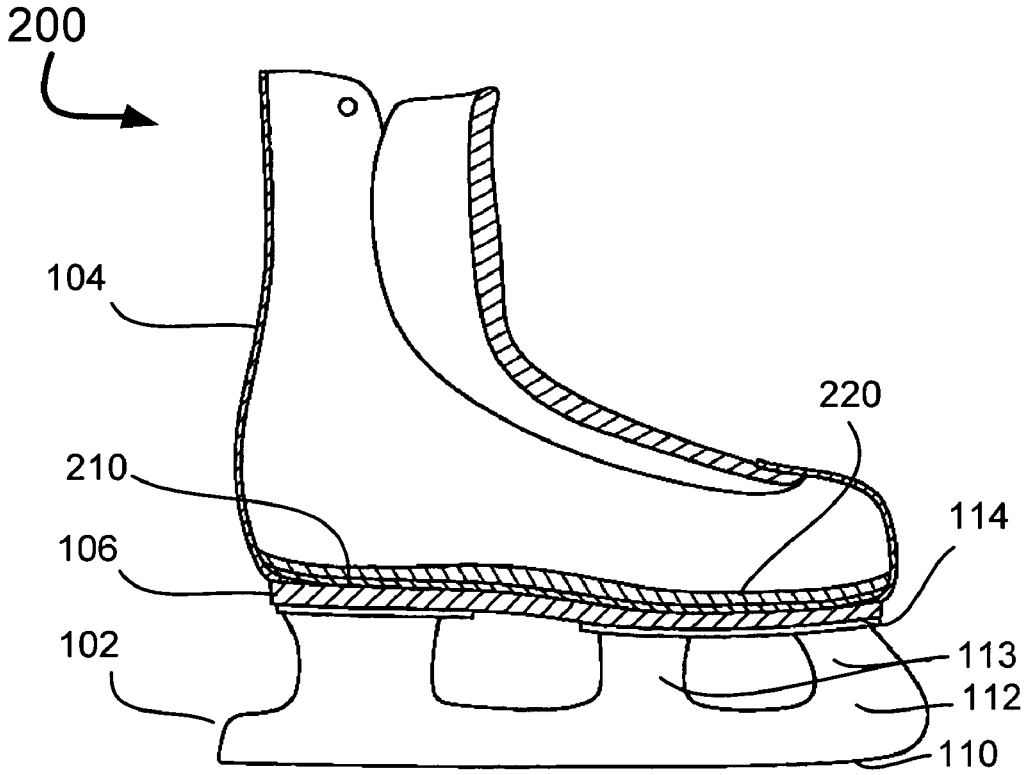
Fig. 2 (Prior Art)
FIG. 2 is a side cutaway elevational view of the conventional hockey skate of FIG. 1.

The boot 300 includes a base 302. In the embodiment shown in FIG. 3, the base 302 includes an upper face 304 formed to engage and support a foot of a wearer (not shown) and a lower face 306 configured to support a skate mechanism. The base 302 is integrally encompassed within the boot 300. Thus, because the base 302 is incorporated within the boot 300, the lack of structural rigidity resulting from having a separate base 106 (FIGS. 1 and 2) coupled to the last board 210 (FIG. 2) are avoided in embodiments of the present invention.

The boot 300 further includes a contoured upper 310. As will be further described in connection with FIGS. 5 and 6, the contoured upper 310 is formed to conform to an anatomical shape of a wearer's foot and ankle. In one presently preferred embodiment, the upper 310 is formed to cover a heel, an ankle, and the metatarsal region of a wearer's foot. By forming the upper 310 to conform to the shape of a wearer's foot and ankle, gaps between the wearer's body and the boot are reduced or eliminated. Thus, the boot 300 provides more complete support to the foot and ankle of the wearer. As a further result of the contouring of the upper 310, movements of the wearer's body are more rapidly, directly, and forcefully received by the boot 300, thus rendering the skate (not shown) to be more responsive to the wearer's movements. Contouring of the upper 310 also reduces a break-in period over which the upper 310 becomes more comfortable for the wearer.

Although rigidity is desirable, it will be appreciated that, in a preferred embodiment of the present invention, some flexibility also is desirable. At a base end 320 of the upper 310, a high degree of rigidity is desired to both support the skate mechanism (not shown) and buttress a base of the wearer's foot where rigid support is desired. On the other hand, at an upper, receiving end 350 of the upper 310 where the ankle of the wearer passes into the upper 310, the upper 310 desirably has some flexibility so that the upper 310 will not dig, cut into, or grate the ankle of the wearer. Some flexibility also is desired at the upper, receiving end 350 of the upper 310 to facilitate closing and securing of the upper 310 to the wearer's foot and ankle. Thus, some flexibility is built into the boot at the upper, receiving end 350. In addition, in a preferred embodiment of the present invention, intermediate degrees of flexibility are built into the upper 310 at a first intermediate layer 340 and a second intermediate layer 330 between the base end 320 of the upper 310 and the upper, receiving end 350 of the upper 310.

Incorporation of the varying rigidity across different zones 320, 330, 340, and 350 of the upper 310 suitably is accomplished in a variety of ways. In one presently preferred embodiment, layers of one or more thicknesses and/or compositions are cut to size and layered over a form and heated to meld the layers together. The layers can be chosen for their physical properties. Long-woven-fiber materials, such as fiberglass or KEVLAR, may be selected for more rigid layers. Further, polyurethane materials may be included to provide impact resistance which may be highly desirable for a hockey skate to protect the wearer from injury.

A polyurethane layer suitably may be an outermost layer of the boot. The outermost layer may be transparent. Thus, the polyurethane layer suitably provides both impact resistance and a graphical design. The graphical design may be disposed on the boot 300 before an outermost layer is applied, or the graphical design may be included in the outermost layer or printed or sublimated on a non-facing side of the layer to protect the graphical design. The transparent layer allows the graphical design and/or the composition of the layers below to show through.

To achieve varying thicknesses, a highest number of layers are deployed at the base end 320 and a fewest number of layers is deployed at the upper, receiving end 350 of the upper. In other words, a first layer may be created and formed around a mold extending from the base 302 through uppermost edges of the upper, receiving end 350. A second layer may be created and formed around the first layer extending from the base through uppermost edges of the first intermediate layer 340. Similarly, a third layer may be created and formed around the second layer extending from the base through uppermost edges of a second intermediate layer 330. Finally, a fourth layer may be created and formed around the third layer extending from the base through uppermost edges of the base end 320. Once the layers are joined together, the result is an upper 310 having varying thicknesses—and commensurate varying rigidities—from the base end 320 through an upper, receiving end 350.

It will be appreciated that the upper 310 can be formed using a number of variations. One variation may include using layers of varying thicknesses. For example, a thin layer may be used as the first layer extending through the upper, receiving end 350 to provide a high degree of flexibility at that point. Thicker layers may then be used for the second, third, and fourth layers to lend added rigidity toward the base end 320. Further, successively thicker layers may be used to further increase rigidity toward the base end 320 of the upper. Alternatively, the upper 310 and the boot 300 could be molded, such as by multi-point injection molded, using a mold having a varying thickness with greater thicknesses toward the base end 320 and lesser thicknesses toward the upper, receiving end 350 to achieve a similar result. Also, different materials could be incorporated in the molding, using more rigid materials for portions of the boot 300 for which higher rigidity is desired. For example, a short fiber material could be used, with materials having a higher concentration of fibers and, thus, a higher rigidity, in portions where higher rigidity is desired. Other materials could be used for parts of the boot 300 where less rigidity is desired.

A lower surface 360 of the boot 310 can be similarly formed. Layers of fiberglass can be wrapped around a lower surface 306 beneath the base 302. Layers also may be placed over the upper surface 304 of the base 302 in what will form a lower interior section of the boot 300 for supporting a bottom of the wearer's foot. Multiple layers suitably may be used, recognizing that the lower surface 360 of the boot 300 appropriately has a high rigidity for receiving and supporting the skate mechanism (not shown). Again, the heating or comparable treatment of the layers causes the boot 300 to form a sturdy, appropriately rigid unified whole. As previously described, layers forming the lower surface 360 also may be molded rather than formed of layers.

Figure 4:
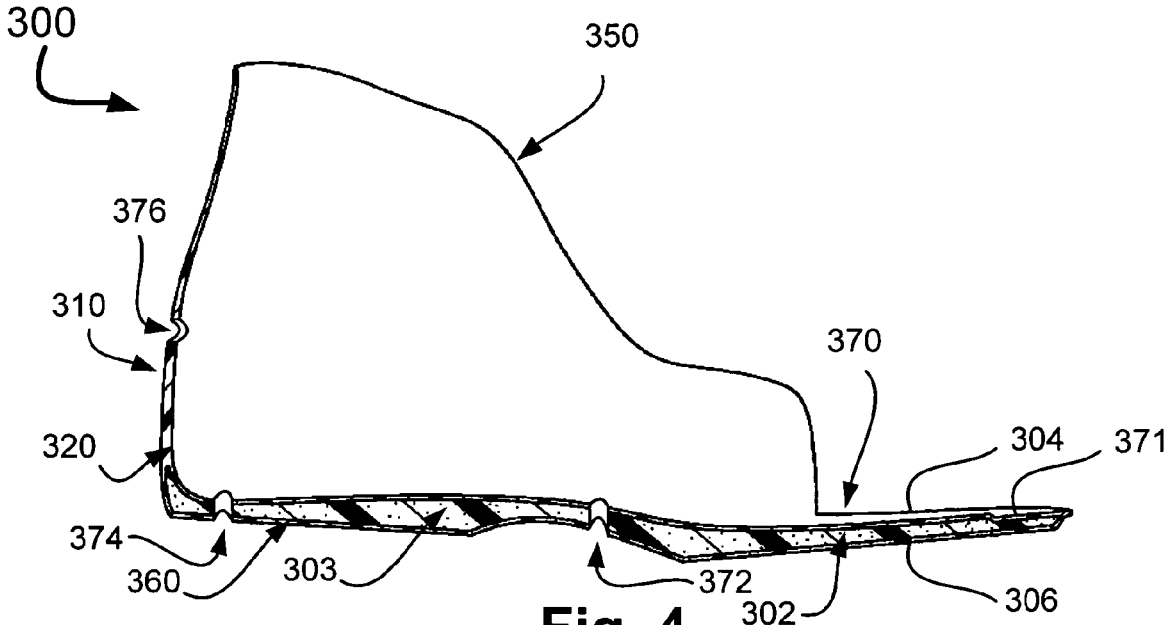
FIG. 4 is a side cutaway view of the boot.

FIG. 4 is a side cutaway view of the boot 300. As shown in FIG. 4, the upper 310 has a greater cross-sectional thickness at the base end 320 and a thinner cross-sectional thickness at the upper receiving end 350. The base 302 is encased within layers or other materials forming the boot and thus is integrated into the boot 300. One or more layers extending across the lower surface 360 of the boot 300 encompass the base 302 from beneath while one or more layers extending over the upper surface 304 of the base 302 encompass the base 302 from above. Again, the result of the layered and joined or molded construction results in a single, unified boot 300.

It will be appreciated that the base 302 suitably may be formed of built up layers of the same material used to form the upper and encompass the base 302. Similarly, the base 302 may be molded as part of a uniform molding process. It is a design choice whether a different material appropriately is used for the base 302 to address design concerns such as weight, rigidity, shock absorption, foot cushioning, or feasibility of manufacture.

In one presently preferred embodiment, the base 302 includes a core section 303 formed from a rigid foam material to balance these concerns, as well as to accommodate integrating skate attachment devices into the boot 300 as is described below in connection with FIG. 6. Forming the base 302 using a core section 303 surrounded by rigid layers creates a torsion box which significantly adds to the rigidity of the base 302. The core section 303 may be previously formed with the base 302 then formed around the core section 303. Alternatively, the core section 303 suitably may be injection molded into a recess left in the base 302.

Figure 5:
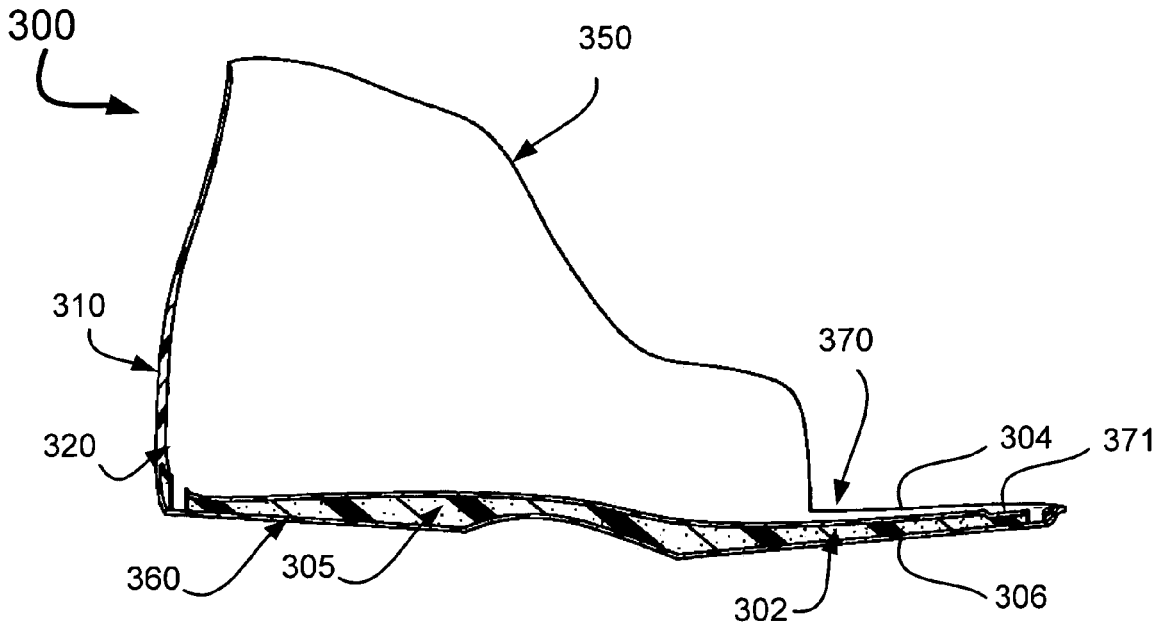
FIG. 5 is a side cutaway view of a boot including a separately formed core section.

As shown in FIG. 5, the core section 305 also may be a separately formed and inserted into the boot. It may be desirable to form a custom-molded core section 305, custom-fit to a particular wearer. The core section 305 could be formed and then inserted into a core section recess in the base 302 left to accommodate the core section. Providing a recess shaped to receive the core section 305 prevents the core section 305 from sliding relative to the base 302 to ensure that undesired movement between the core section 305 and the base 302 does not result in attenuation of responsiveness to movements of the wearer's foot. Alternatively, even if the core section 305 is not custom molded, the core section 305 may be molded to accommodate protrusions (not shown) resulting from inserts incorporated in the base 302.

FIG. 4 also shows a toe cap recess 371 configured to receive a toe cap (not shown). In one embodiment, the toe cap might be shaped to engage and be coupled with the upper surface 304 of the base 302. Alternatively, the toe cap may rest against and be coupled with a front edge of the base 302. In one presently preferred embodiment, the toe cap and the boot 300 are formed such that the upper 310 of the boot 300 overlaps a trailing edge of the toe cap. The overlapping construction ensures rigidity of the completed boot and toe cap construction, with the overlapping construction providing further protection for the wearer's foot.

FIG. 4 also shows a plurality of ventilation openings 372, 374, and 376 extending through the boot 300. One or more arch ventilation openings 372 may extend through an arch section of the boot 300. Heel ventilation openings 374 may extend through the heel of the boot 300. Upper ventilation openings 376 may extend through the upper of the boot 300. It will be appreciated that the openings 372, 374, and 376, will not only allow for ventilation of heat, but also for evaporation of perspiration. It also will be appreciated that a lining (not shown in FIG. 4) suitably permeably cover the openings 372, 374, and 376 to cushion surfaces of the openings 372, 374, and 376 without impermeably sealing the openings.

Figure 6:
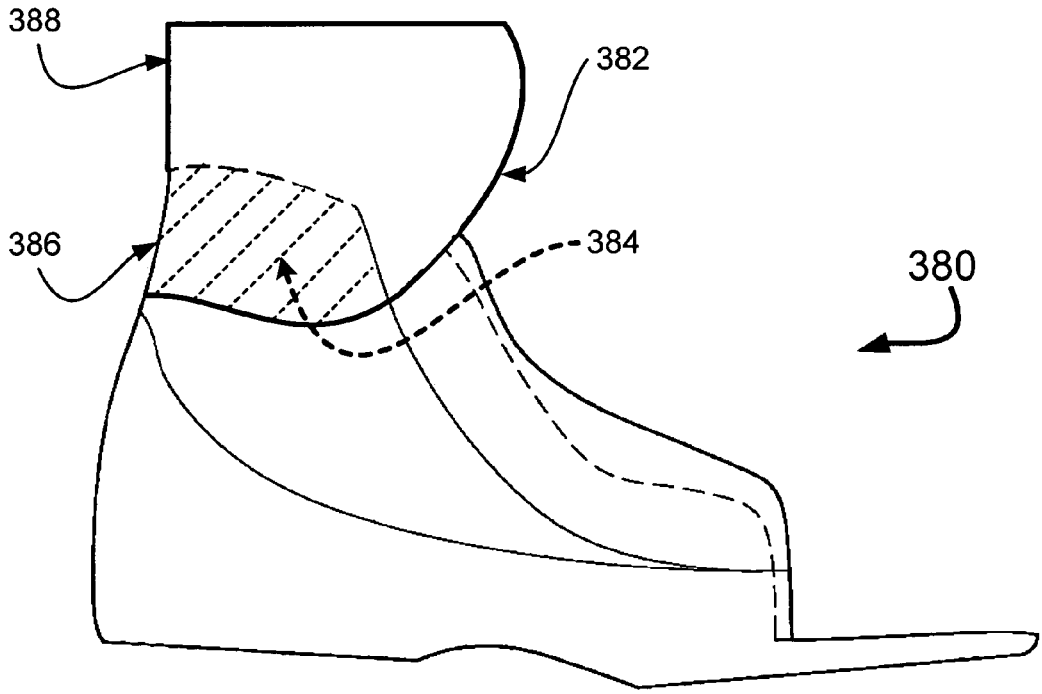
FIG. 6 is a side elevational view of the boot to show arrangement of a hingably-attached layer incorporated in the boot structure.

FIG. 6 is a side elevational view of a boot 380 showing a variation of the construction. The boot 380 includes a hingably coupled layer 382. The hingably coupled layer 382 is joined to an underlying surface 384 using the same techniques used to join other layers as previously described. However, the hingably-attached layer 382 is only partially attached to an underlying surface 384 at an attached portion 386, leaving an unattached portion 388 engaging an upper portion of the wearer's leg (not shown). If the hingably coupled layer 382 includes a suitably flexible material, the unattached portion 388 of hingably coupled layer 382 can flex between the wearer's leg and the attached portion 386. Thus, the unattached portion 388 acts as a relatively flexible cuff to provide additional support to the wearer while restricting the wearer's movements less than a fully attached layer potentially could restrict the wearer's movements.

Figure 7:
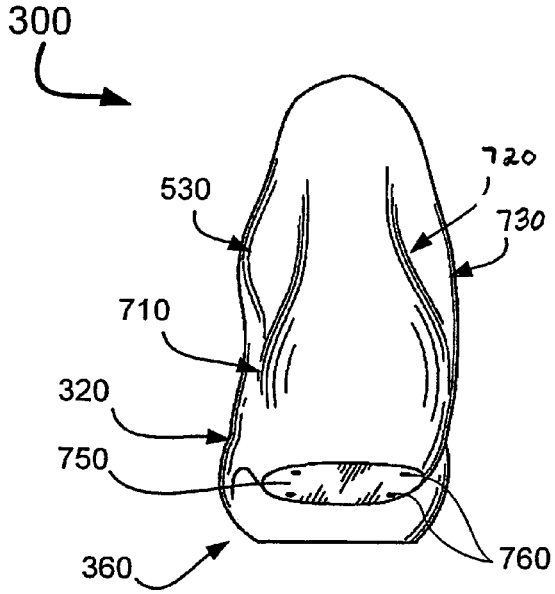
FIG. 7 is a rear elevational view of the boot.

FIG. 7 is a rear elevational exterior view of the boot 300. As can be appreciated from FIG. 7, the boot 300 is formed to contour to the anatomy of the wearer's foot and ankle. For example, the boot 300, at its base end 320, is appropriate wide to accommodate a width of the wearer's foot (not shown). However, extending upward from the base end 320, it can be seen that the boot 300 includes a heel contour 710 shaped to accommodate and conform to a shape of the wearer's heel. Extending upward from the heel contour 710 is an ankle contour 720. The ankle contour 720 narrows from the heel contour to follow a narrowed shape along a back of the wearer's ankle. Also, each side of the boot 300 includes an ankle joint pocket 730 to accommodate protrusions situated where the wearer's ankle joint extends outwardly to the sides between the wearer's foot and ankle. Sculpting of the boot 300 thus conforms to the anatomy of the wearer to provide support, comfort, and responsiveness.

FIG. 7 also shows how the lower surface 360 is configured to engage a mounting bracket of a skate mechanism (not shown). The lower surface 360 includes a flattened heel receiving surface 750 configured to securely engage a corresponding flattened surface on the mounting bracket of the skate mechanism. In addition, the lower surface 360 includes a plurality of openings 760 for receiving attachment devices (not shown) for coupling the boot 300 to the skate mechanism (not shown). Skate attachment devices, in the nature of fasteners such as bolts, screws, scrivets, rivets, or other attachment devices are received through the openings where they are engaged by inserts (not shown) integrated within the boot 300, as will be further described in connection with FIG. 8.

Figure 8:
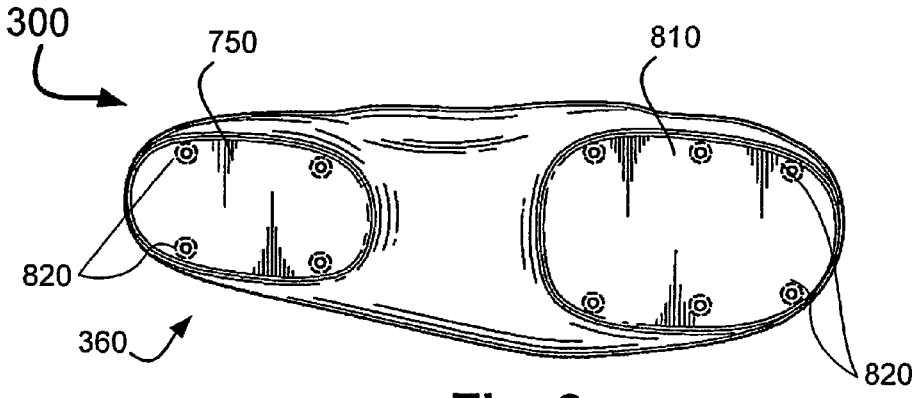
FIG. 8 is a bottom partial cutaway view of the boot using integrated inserts to engage a skate mechanism.

FIG. 8 is a bottom partial cutaway view of the boot 300. FIG. 8 shows the lower surface 360 of the boot including the flattened heel receiving surface 750 and a corresponding flattened front-foot receiving surface 810 for engaging corresponding flattened surfaces on a skate mechanism (not shown). The flattened heel receiving surface 750 and the flattened front-foot engaging surface 810 flank the arch support 370 configured to conform to and provide support to an arch of the wearer's foot.

Inside the flattened receiving surfaces 750 and 810 of the foot are mounted inserts 820 for engaging and attaching a skate mechanism to the boot. In one presently preferred embodiment shown, the inserts 820 include inwardly-threaded, female connectors each of which is configured to receive a corresponding outwardly threaded male connector (not shown) extending through the skate mechanism. Engagement of the male connectors couples the skate mechanism to the boot 300. In one presently preferred embodiment, the inserts are encompassed within the base 302 (FIGS. 3 and 4) integrated within the boot 300. A molded base can be molded around the inserts 820 to rigidly secure the inserts 820 within the boot.

Rigidly integrating the inserts 820 within the boot 300 advantageously increases the responsiveness of a skate by helping to translate movements of the wearer to the skate mechanism with less attenuation. Disposing inserts 820 around a perimeter of the base 302 provides structural support for lateral movement that is not available in conventional skates. It will be appreciated that other suitable means for integrating inserts 820 into the boot suitably are used. Different couplings could be used instead of inwardly-threaded female connectors. For example, outwardly threaded male connectors could be encompassed in the base and configured to engage inwardly-threaded female connectors associated with the skate bracket. Alternatively, the inserts 820 suitably may include rigid sleeves mounted either perpendicularly or in parallel with the lower surface 360 of the boot and configured to receive attaching devices having their own coupling devices at either end. Also, it will be appreciated that the inserts 820 could be molded into a lower surface 360 of the boot 300, particularly if the boot itself is molded. The inserts 820 suitably are held in place by an appropriate die during the molding process.

Figure 9:
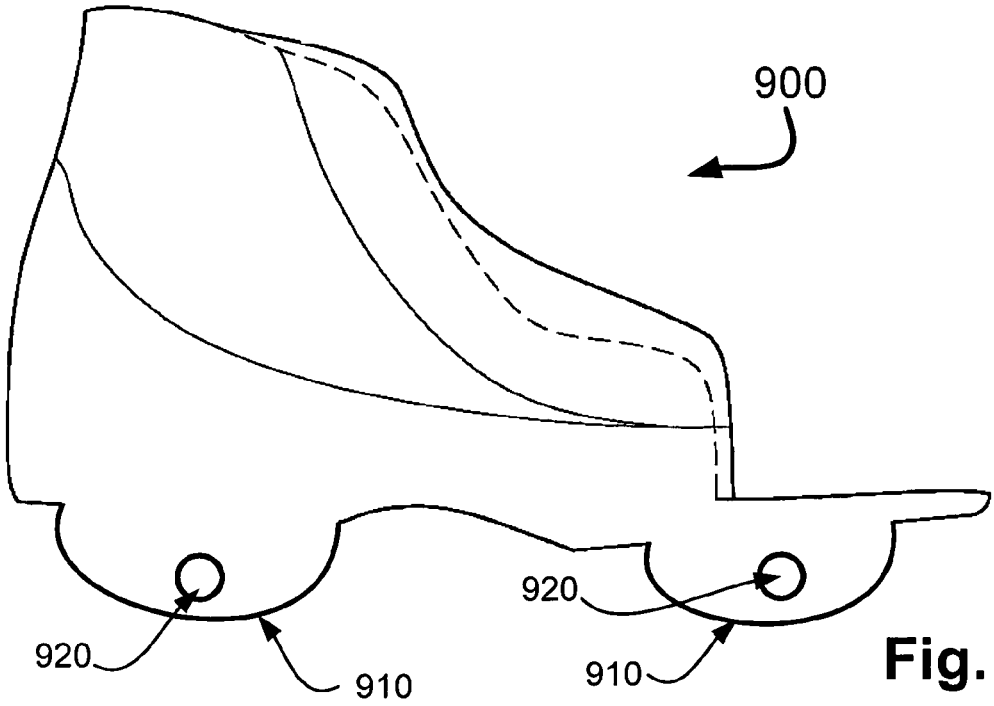
FIG. 9 shows a side elevational view of the boot incorporating an integrated lug to engage a skate mechanism.

FIG. 9 shows a side elevational view of an alternative embodiment of a boot 900 including one or more integrated attachment lugs 910. The integrated attachment lug 910 is integrated into the boot 900. The lugs 910 can be molded as part of a molded boot 900. Alternatively, lug cores (not shown) may be situated on or as part of the base, and one or more layers built up around the lug core.

The lugs 910 provide a rigid attachment mechanism to engage a skate mechanism. As will be further described below, the lugs 910 may provide structural support to the skate mechanism. The lugs 910 may include attachment points 920, which are openings through which attachment devices (not shown) join the skate mechanism to the boot 900. As can be seen in FIG. 6A, the attachment points 920 of the lugs 910 allow the skate mechanism to be coupled with the boot 900 using attachment devices extending parallel to a bottom surface of the base instead of penetrating into the base perpendicularly to the base.

Figure 10A:
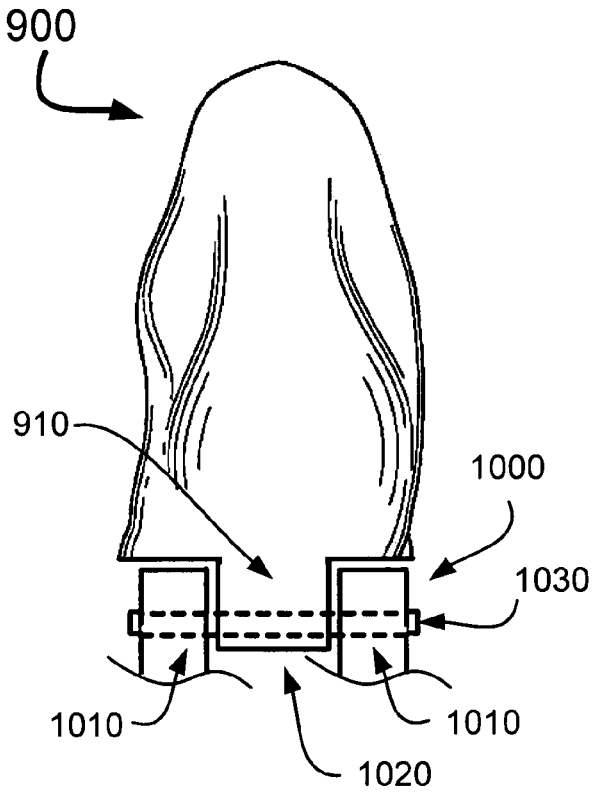
FIG. 10A shows a rear elevational view of the skate mechanism coupled to one configuration of a boot having an integrated lug.

FIG. 10A shows a rear elevational view of the boot 900 being coupled with a skate mechanism 1000. The skate mechanism includes a recess 670 configured to receive the interleavably lugs 910. The lugs 910 and side portions 1010 of the skate mechanism defining a recess 1020, when coupled together, form a skate bracket to provide a rigid support for the skate, thereby providing lateral stability for the wearer. It will be appreciated that preferably there would be no appreciable gap between the lugs 910 and the skate mechanism for optimal rigidity. Nonetheless, some gaps are shown in FIG. 10A for clarity of explanation.

The skate mechanism 1000 is joined to the lugs 910 using an attachment device 1030 extending through an opening in the side portions 1010 and through the attachment points. The attachment device 1030 suitably includes a bolt and nut, a rivet, or another attachment device configured to couple the side portions 1010 to the lugs 910.

Figure 10B:
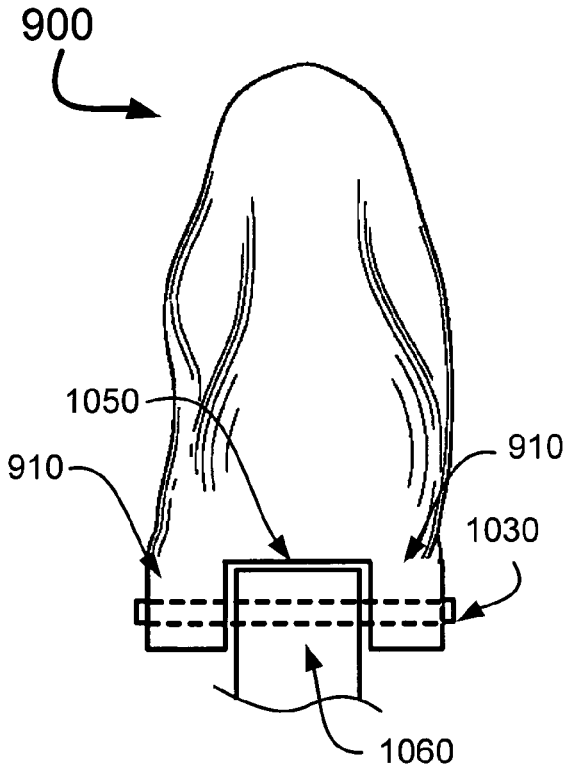
FIG. 10B shows a rear elevational view of the skate mechanism coupled to another configuration of a boot having an integrated lug.

FIG. 10B shows a rear elevational view of the boot having, instead of a recess 1030 being formed in the skate mechanism 1000, a plurality of lugs 910 could be formed on opposing sides of the base with a space between the lugs 910 defining a recess 1050 configured to interleavably receive a skate mechanism 1060. In either configuration, the lugs 910 and the skate mechanism 1000 or 1060 are interleavably engaged in a generalized tongue-and-groove arrangement and secured by one or more attachment devices 1030.

Figure 11:
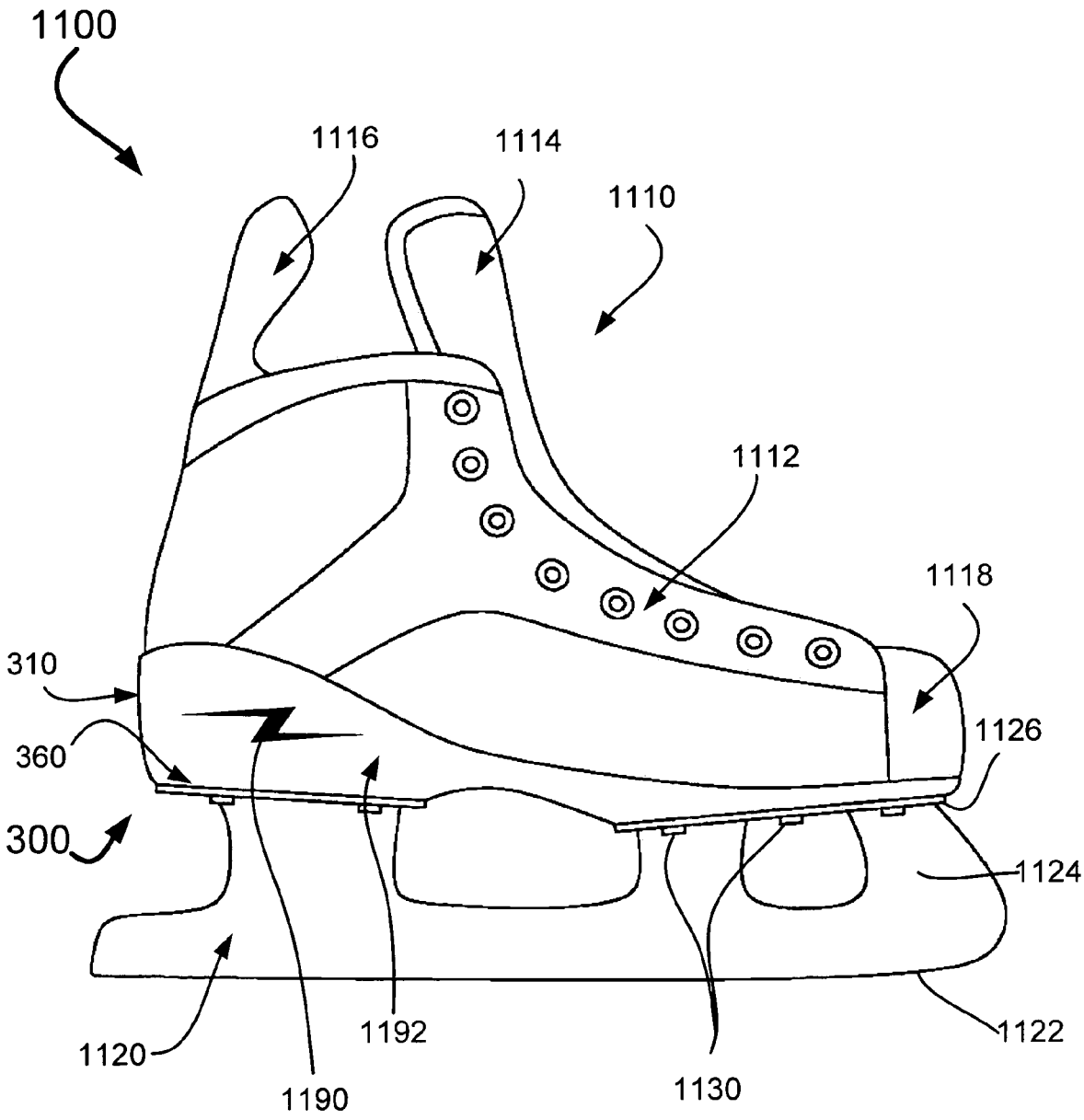
FIG. 11 is a side elevational view of a skate using the boot.

FIG. 11 is a side elevational view of a skate 1100 using an embodiment of the boot 300 according to the present invention. In one presently preferred embodiment, a skate upper 1110 is bonded to upper surfaces of the upper 310 of the boot 300 using adhesives, thermal bonding, and/or other suitable techniques. A lower surface 360 of the boot 300 engaging the skate mechanism 1120 remains uncovered. The skate upper 1110 includes a lace-receiving system 1112, a tongue 1114, an ankle support 1116, and a toebox 1118. In one presently preferred embodiment of the present invention, the upper 310 of the boot 300 is largely covered by the skate upper 1110. However, some portion of the upper 310 above the lower surface 360 of the boot 300 may remain uncovered.

The skate mechanism 1120, which includes a blade 1122, a skate bracket 1124 configured to support the blade 1122, and a base 1126. The base 1126 is coupled to the lower surface 360 of the boot 310. Attachment devices 1130 extend through the base 1126 into the lower surface 360 and the base 302 (FIGS. 3 and 4) of the boot 300 where they engage the inserts (not shown). In the embodiment shown, the attachment devices are outwardly-threaded male connectors configured to engage inwardly-threaded female connectors integrated into the boot 300.

FIG. 11 also shows a graphic design 1190 disposed on the boot 300. An outer surface of the boot 300 may include a graphic design 1190 disposed as part of or beneath an outer layer 1194 of the boot 300 as previously described. The outer layer 1192 of the boot 300 may include a transparent material. The transparent material may include a polyurethane material, such that the outer layer 1192 suitably may be configured to provide impact resistance as previously described. The graphic design 1190 may be disposed on a layer of the boot 300 beneath the outer layer 1192 where the transparent layer 1192 protects the graphic 1190. The graphic 1190 also suitably is integrated into the outer layer 1192 or sublimated onto the transparent outer layer 1192. The transparent outer layer 1192 allows the underlying construction to show through.

Figure 12:
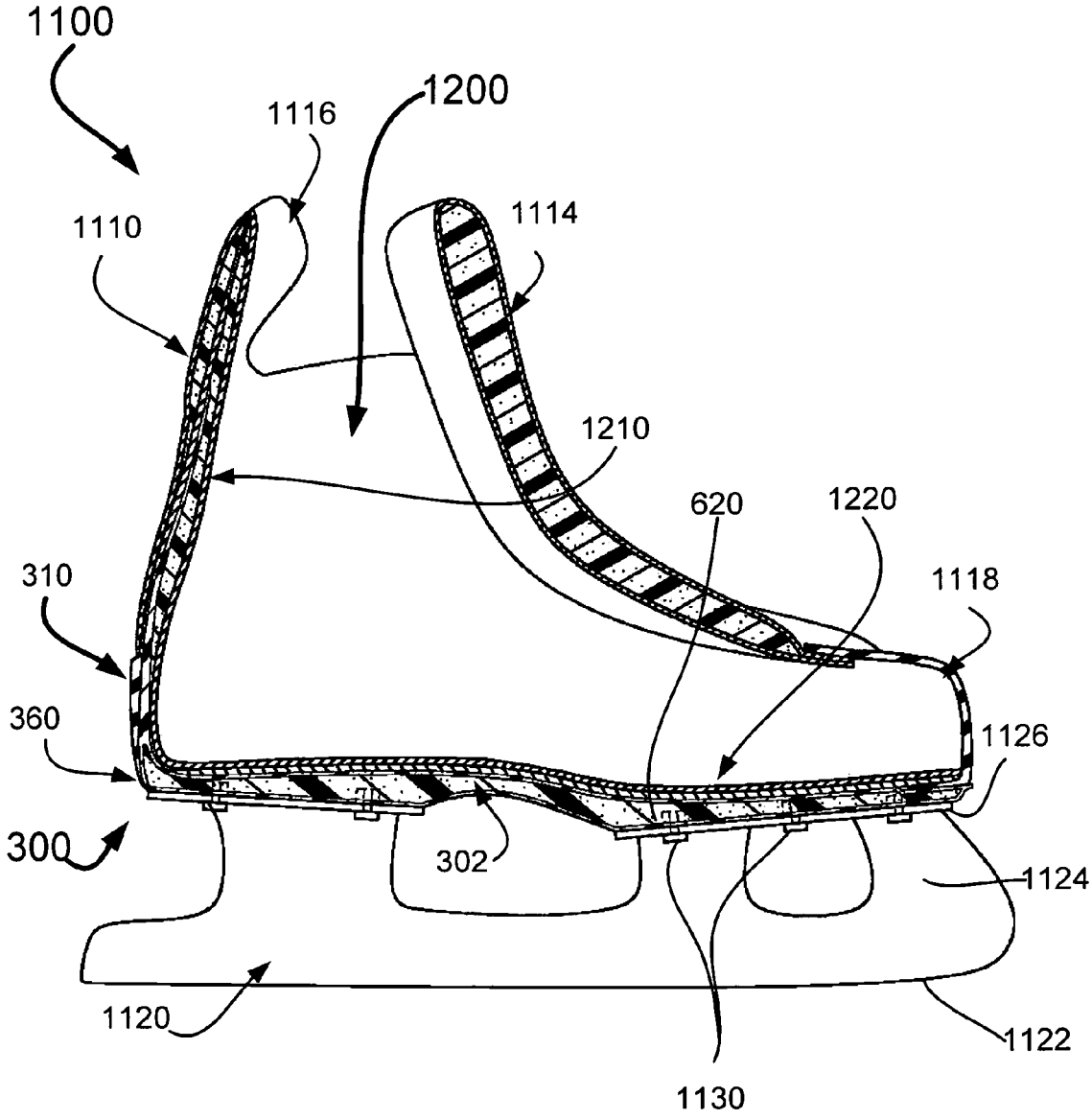
FIG. 12 is a side cutaway view of the skate of FIG. 11.

FIG. 12 is a side cutaway view of the skate 1100 using the boot 300. In addition to an upper 310 of the skate boot 300 being partially covered by the skate upper 710 on an exterior of the boot 300, an interior 1200 of the boot is covered by a liner 1210. The liner 1210, formed of a soft lining material, lines the interior surface 1200 of the boot 300 to provide cushioning and comfort to the wearer. For further comfort, cushioning, and support, an insole 1220 is disposed on a bottom surface of the interior 1200 of the boot 300.

FIG. 12 illustrates how the skate mechanism 1120 is secured to the lower surface 360 of the boot 300. The male attachment devices 1130 extend through the base 1126 of the skate mechanism through the lower surface 360 of the boot 300 into the base 302 of the boot 300. Inserts 620 integrally secured within the base 12 receive and engage the attachment devices 1130, coupling the skate mechanism 1120 to the boot.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A skate boot apparatus comprising:

a base including an upper face configured to receive a wearer's foot and a lower face configured to structurally support a skate mechanism, wherein the base includes a resin-impregnated, fabric composite shell and a core, the core having a lower density than the shell, the shell surrounding the core;

an upper structural support integrated with the base and extending upwardly from the base to a point above a wearer's ankle, the upper support having an area of a first rigidity above and adjacent the base and at least a second rigidity lower than the first rigidity in a majority of the portion of the upper support above the area of first rigidity;

an outer shell secured outside said upper support;

an inner liner secured inside said upper support; and a plurality of integrated threaded inserts configured to releasably engage a plurality of threaded fasteners to couple the base to the skate mechanism, said base being molded around said inserts, wherein the plurality of inserts are disposed toward circumferential edges of the base with a portion of the insert being supported by the shell of the base and a portion of the inserts being disposed within the core.

2. A skate boot apparatus comprising:

a base including an upper face configured to receive a wearer's foot and a lower face configured to structurally support a skate mechanism, wherein the base includes a resin-impregnated, fiber composite shell surrounding a lower density core;

an upper structural support integrated with the base and extending upwardly from the base to a point above a wearer's ankle, the upper support having an area of a first rigidity above and adjacent the base and at least a second rigidity lower than the first rigidity in a majority of the portion of the upper support above the area of first rigidity;

an outer shell secured outside said upper support; and an inner liner secured inside said upper support.

3. A skate boot apparatus comprising:

a base including an upper face configured to receive a wearer's foot and a lower face configured to structurally support a skate mechanism, wherein the base includes a resin-impregnated, fabric composite shell and a core, the core being of lower density material, the shell surrounding the core, the skate further comprising at least one integral lug extending generally downwardly from the base to engage the skate mechanism, the core of the base extending into the lug;

an upper structural support integrated with the base and extending upwardly from the base to a point above a wearer's ankle, the upper support having an area of a first rigidity above and adjacent the base and at least a second rigidity lower than the first rigidity in a majority of the portion of the upper support above the area of first rigidity;

an outer shell secured outside said upper support; and an inner liner secured inside said upper support.

4. The apparatus of claim 3, wherein the integral lug includes at least one attachment point extending through the integral lug in a direction generally parallel to the lower face of the base, the attachment point being configured to receive a skate attachment device and hold the skate attachment device from translational movement relative to the base.

5. The apparatus of claim 3, wherein the integral lug is configured to interleavably engage lateral and medial sides of a skate mechanism.

6. A skate boot apparatus comprising:

a base including an upper face configured to receive a wearer's foot and a lower face configured to structurally support a skate mechanism, wherein the base includes a core section between the upper face and the lower face, the upper and lower faces being connected around the sides of the core, the faces and sides forming a resin-impregnated, fiber composite shell around the core, the core having a lower density than the shell;

an upper structural support integrated with the base and extending upwardly from the base to a point above a wearer's ankle, the upper support having an area of a first rigidity above and adjacent the base and at least a second rigidity lower than the first rigidity in a majority of the portion of the upper support above the area of first rigidity;

an outer shell secured outside said upper support; and an inner liner secured inside said upper support.

7. The apparatus of claim 6, wherein the shell is molded around the core.

8. The apparatus of claim 6, wherein core section includes a rigid foam material encased by the shell on all sides.

9. The apparatus of claim 6, wherein core section includes a plurality of recesses to accommodate inserts coupled with the base, the inserts having protrusions extending into an interior of the boot, the inserts abutting a least a portion of the shell.

10. The apparatus of claim 6, wherein the core section is formed separately from the boot and received into a core section recess in the boot.

11. The apparatus of claim 10, wherein the core section is custom formed to accommodate the wearer's foot.

12. The apparatus of claim 10, wherein the core section is bonded to the upper surface of the base of the boot.

13. A skate boot apparatus comprising:

a base including an upper face configured to receive a wearer's foot and a lower face configured to structurally support a skate mechanism;

an upper structural support integrated with the base and extending upwardly from the base to a point above a wearer's ankle, the upper support having an area of a first rigidity above and adjacent the base and at least a second rigidity lower than the first rigidity in a majority of the portion of the upper support above the area of first rigidity, wherein the upper structural support is formed by curing together a plurality of layers of fiber composite material set and joined together with a resin;

an outer shell secured outside said upper support; and an inner liner secured inside said upper support.

14. The apparatus of claim 13, wherein a varying rigidity of the upper structural support ranging from the first rigidity to the second rigidity is created by using a varying number of the layers, wherein sections of the upper structural support having a high rigidity include a first number of the layers and sections of the upper structural support having the low rigidity include a second number of the layers where the first number is greater than the second number.

15. The apparatus of claim 13, wherein the varying rigidity of the upper structural support is created by using layers including layers of varying compositions, each of the varying compositions having varying rigidities.

16. The apparatus of claim 13, wherein the layers include at least one hingably coupled layer, the hingably coupled layer being partially joined with the boot toward the base and being partially unjoined with the boot away from the base such that the hingably coupled layer is movable at an upper end configured to receive the wearer's ankle.

17. The apparatus of claim 13, wherein the layers include at least one of a long-woven fiber material.

18. The apparatus of claim 17, wherein the long-woven fiber material includes one of a fiberglass, a carbon-fiber, and an aramid fiber.

19. The apparatus of claim 13, further comprising an impact-resistant material layered over the outer layer of composite material.

20. The apparatus of claim 19, wherein the impact-resistant material includes a polyurethane plastic.

21. The apparatus of claim 19, wherein the layer of impact-resistant material is an outermost layer of the boot.

22. The apparatus of claim 21, wherein the layer of impact-resistant material is transparent.

23. The apparatus of claim 22, further comprising a graphical design wherein the layer of impact-resistant material is disposed to at least partially protect a graphical design disposed beneath an outer surface of the layer of impact-resistant material.

24. The apparatus of claim 23, wherein the graphical design is sublimated on a non-outward-facing side of the layer of impact-resistant material.

25. The apparatus of claim 13, wherein the varying rigidity of the upper structural support is created by molding using a varying thickness wherein sections of the upper structural support having a high rigidity include a first thickness and sections of the upper structural support having the low rigidity include a second thickness where the first thickness is greater than the second thickness.

26. The apparatus of claim 13, wherein the varying rigidity of the upper structural support is created by molding using a material of varying rigidity wherein sections of the upper structural support having a high rigidity include a first material and sections of the upper structural support having the low rigidity include a second material where the first material is more rigid than the second material.

27. The apparatus of claim 26, wherein at least one of the first material and the second material includes a short fiber material.

28. The apparatus of claim 27, wherein a rigidity of the short fiber material is increasable by increasing a fiber concentration in the short fiber material.

29. A skate boot apparatus comprising:

a base including an upper face configured to receive a wearer's foot and a lower face configured to structurally support a skate frame; and a boot encompassing the base within a bottom side, the boot including:

a contoured upper support extending upwardly past the upper face of the base to surround an ankle joint, a heel, and at least a portion of a foot of the wearer, the contoured upper support having a first rigidity near the base and a second rigidity near the point above the wearer's ankle lower than the first rigidity, the contoured upper support having a plurality of layers with more layers adjacent the base and fewer layers above the wearer's ankle;

a shaped lower surface extending from the contoured upper support beneath the lower face of the base, the shaped lower surface being configured to engage the skate frame;

an outer layer secured outside the upper support; and an inner liner secured inside the upper support.

30. The apparatus of claim 29, wherein the shaped lower surface includes a plurality of integrated inserts configured to releasably engage a plurality of skate attachment devices to couple the base to the skate frame.

31. The apparatus of claim 30, wherein the plurality of inserts are disposed toward circumferential edges of the base, the base including a fiber composite shell and a core having a lower density than the shell, the shell surrounding the core, the inserts being supported adjacent the shell and within the core.

32. The apparatus of claim 29, wherein the shaped lower surface includes at least one integral lug extending generally downwardly from the base to engage the skate frame, the lug being formed, at least in part from the layers used to form at least a portion of the base.

33. The apparatus of claim 32, wherein the integral lug includes at least one attachment point extending through the integral lug in a direction generally parallel to the lower face of the base, the attachment point being configured to receive a skate attachment device and hold the attachment device from significant translational movement relative to the base.

34. The apparatus of claim 32, wherein the integral lug is configured to interleavably engage a skate mechanism on the lateral and medial sides thereof.

35. The apparatus of claim 29, wherein the base includes a core section, the core section being one of fixably molded within the boot and injection molded into a recess formed within the boot.

36. The apparatus of claim 29, wherein the base is configured to receive a core section, the core section being separately formed to accommodate the wearer's foot of an identified wearer and received into a core section recess in the boot.

37. The apparatus of claim 29, wherein the layers of the contoured upper are set in a thermoplastic resin and custom formed to accommodate at least one of the wearer's foot and the wearer's ankle of an identified wearer.

38. The apparatus of claim 29, wherein a varying rigidity of the boot ranging from the first rigidity to the second rigidity is created by using a varying number of the layers within the upper support, wherein sections of the boot having a high rigidity include a first number of the layers and sections of the boot having the low rigidity include a second number of the layers where the first number is greater than the second number.

39. The apparatus of claim 29, wherein a varying rigidity of the boot ranging from the first rigidity to the second rigidity is created by using layers within the upper support, including layers of varying compositions, each of the varying compositions having varying rigidities.

40. The apparatus of claim 29, wherein the layers within the upper support include at least one hingably coupled layer, the hingably coupled layer being partially joined with toward the base and being partially unjoined with adjacent layers away from the base such that the hingably coupled layer is movable at an upper end configured to receive the wearer's ankle.

41. The apparatus of claim 29, wherein the layers within the upper support include at least one of a long-woven fiber material.

42. The apparatus of claim 41, wherein the long-woven fiber material includes one of a fiberglass, a carbon-fiber, and an aramid fiber.

43. The apparatus of claim 29, further comprising an impact-resistance material affixed to the outermost composite layer.

44. The apparatus of claim 43, wherein the impact-resistant material includes a polyurethane plastic.

45. The apparatus of claim 43, wherein the layer of impact-resistant material is an outermost layer of the boot.

46. The apparatus of claim 45, wherein the layer of impact-resistant material is transparent.

47. The apparatus of claim 46, further comprising a graphical design wherein the layer of impact-resistant material is disposed to at least partially protect a graphical design disposed beneath an outer surface of the layer of impact-resistant material.

48. The apparatus of claim 47, wherein the graphical design is sublimated on a non-outward-facing side of the layer.

49. The apparatus of claim 29, wherein the varying rigidity of the boot is created by molding the upper support using a varying thickness wherein sections of the boot having a high rigidity include a first thickness of the upper support and sections of the boot having the low rigidity include a second thickness of the upper support, where the first thickness is greater than the second thickness.

50. The apparatus of claim 29, wherein the varying rigidity of the boot is created by molding the upper support using a material of varying rigidity wherein sections of the boot having a high rigidity include a first material within the upper support and sections of the boot having the low rigidity include a second material within the upper support where the first material is more rigid than the second material.

51. The apparatus of claim 50, wherein at least one of the first material and the second material includes a short fiber material.

52. The apparatus of claim 51, wherein a rigidity of the short fiber material is increasable by increasing a fiber concentration in the short fiber material.

53. The apparatus of claim 29, wherein the upper support is configured to extend generally over a metatarsal of the wearer's foot.

54. The apparatus of claim 29, wherein the upper support is configured to receive a toe cap, the upper support being configured to at least partially extend over a trailing edge of the toe cap.

55. The apparatus of claim 29, wherein the upper face of the base includes a recess for receiving an edge of a toe cap.

56. The apparatus of claim 29, wherein at least one of the base and the upper support include a ventilation opening extending through the upper support.

57. The skate boot of claim 29, wherein said shaped lower surface includes at least two generally planar engagement regions and an arch-shaped region between said engagement regions.

58. An ice skate system comprising:

a skate mechanism including:

a skating device;

a skate frame supporting the skating device on a first side and configured to engage a mounting bracket on a second side; and a mounting bracket coupled with the skate frame, the mounting bracket being configured to mount the skate mechanism;

a boot including:

a base including an upper face configured to receive a wearer's foot and a lower face configured to structurally support the skate mechanism, the base including a plurality of inserts configured to receive a plurality of skate attachment devices; and a boot encompassing the base within a bottom side, the boot including:

a contoured upper support extending upwardly past the upper face of the base to surround an ankle joint, a heel, and at least a portion of a foot of the wearer, the contoured upper support having a first rigidity near the base and at least a second rigidity in a majority of the portion of the boot above the area of first rigidity, the second rigidity being lower than the first rigidity; and a shaped lower surface extending continuously from the contoured upper support beneath the lower face of the base and shaped to receive an upper face of the skate mechanism;

a boot lining disposed inside the upper support and configured to receive the foot of the wearer; and a plurality of skate attachment devices configured to join the skate mechanism to the boot.

59. The system of claim 58, wherein the shaped lower surface includes a plurality of integrated inserts configured to engage a plurality of skate attachment devices to couple the base to the skate mechanism.

60. The system of claim 59, wherein the plurality of inserts are disposed toward circumferential edges of the base.

61. The system of claim 58, wherein the shaped lower surface includes at least one integral lug extending generally downwardly from the base to engage the skate mechanism.

62. The system of claim 61, wherein the integral lug includes at least one attachment point extending through the integral lug in a direction generally parallel to the lower face of the base, the attachment point being configured to receive a skate attachment device.

63. The system of claim 61, wherein the integral lug is configured to interleavably engage a skate mechanism.

64. The system of claim 63, wherein the layers include at least one of a long-woven fiber material.

65. The system of claim 64, wherein the long-woven fiber material includes one of a fiberglass, a carbon-fiber, and an aramid fiber.

66. The system of claim 58, wherein the base includes a core section, the core section being one of fixably molded within the boot and injection molded into a recess formed within the boot.

67. The system of claim 58, wherein the base is configured to receive a core section, the core section being separately formed to accommodate the wearer's foot of an identified wearer and received into a core section recess in the boot.

68. The system of claim 67, wherein the core section is custom formed to accommodate the wearer's foot of an identified wearer.

69. The system of claim 58, wherein the contoured is custom formed to accommodate at least one of the wearer's foot and the wearer's ankle of an identified wearer.

70. The system of claim 58, wherein the upper support is formed by joining a plurality of composite material layers.

71. The system of claim 70, wherein a varying rigidity of the boot ranging from the first rigidity to the second rigidity is created by using a varying number of the layers within the upper support, wherein sections of the boot having a high rigidity include a first number of the layers within the upper support and sections of the boot having the low rigidity include a second number of the layers within the upper support where the first number is greater than the second number.

72. The system of claim 70, wherein the varying rigidity of the boot is created by using layers within the upper support, including layers of varying compositions, each of the varying compositions having varying rigidities.

73. The system of claim 70, wherein the layers include at least one hingably coupled layer, the hingably coupled layer being partially joined with a remainder of the upper support toward the base and being partially unjoined with the boot away from the base such that the hingably coupled layer is movable at an upper end configured to receive the wearer's ankle.

74. The system of claim 70, further comprising an impact-resistant material layered to the outermost composite material layer.

75. The system of claim 74, wherein the impact-resistant material includes a polyurethane plastic.

76. The system of claim 74, wherein the layer of impact-resistant material is an outermost layer of the boot.

77. The system of claim 76, wherein the layer of impact-resistant material is transparent.

78. The system of claim 77, further comprising a graphical design wherein the layer of impact-resistant material is disposed to at least partially protect a graphical design disposed beneath an outer surface of the layer of impact-resistant material.

79. The system of claim 78, wherein the graphical design is sublimated on a non-outward outward-facing side of the layer.

80. The system of claim 70, wherein the varying rigidity of the boot is created by molding using a varying thickness of the upper support wherein sections of the boot having a high rigidity include a first thickness and sections of the boot having the low rigidity include a second thickness where the first thickness is greater than the second thickness.

81. The system of claim 70, wherein the varying rigidity of the boot is created by molding of the upper support using a material of varying rigidity wherein sections of the boot having a high rigidity include a first material and sections of the boot having the low rigidity include a second material where the first material is more rigid than the second material.

82. The system of claim 81, wherein at least one of the first material and the second material includes a short fiber material.

83. The system of claim 82, wherein a rigidity of the short fiber material is increasable by increasing a fiber concentration in the short fiber material.

84. The system of claim 58, wherein the upper support is configured to extend generally over a metatarsal of the wearer's foot.

85. The system of claim 58, wherein the upper support is configured to receive a toe cap, the upper support being configured to at least partially extend over a trailing edge of the toe cap.

86. The system of claim 58, wherein the upper face of the base includes a recess for receiving an edge of a toe cap.

87. The system of claim 58, wherein at least one of the base and the upper support include a ventilation opening extending through the upper support.

88. The ice skate system of claim 58, wherein said shaped lower surface includes at least two engagement regions to receive an upper face of the skate mechanism, said shaped lower surface being arch-shaped between said engagement regions.

89. A method for forming a skate boot, the method comprising:

forming a base including:

forming the base with an upper face configured to receive a wearer's foot; and forming a lower face configured to structurally support a skate mechanism; and forming a boot including:

forming an upper support around the base with a plurality of layers of composite material extending upward integrally from the base;

contouring the upper support of the boot to surround a wearer's ankle, a wearer's heel, and at least a portion of a wearer's foot, the upper support having a first rigidity near the base and at least a second rigidity in a majority of the portion of the boot above the area of first rigidity, the second rigidity being lower than the first rigidity; and shaping a lower surface of the boot beneath the lower face of the base to receive the skate mechanism.

90. The method of claim 89, further comprising shaping the lower surface to integrate a plurality of inserts in the boot, the inserts being configured to releasably engage a plurality of skate attachment devices to couple the skate mechanism to the boot.

91. The method of claim 90, further comprising molding the base to at least partially encompass the inserts.

92. The method of claim 89, wherein the base includes a shell and a core having a lower density than the shell, the method further comprising shaping the lower surface to include at least one integral lug extending generally downwardly from the base to engage the skate mechanism, the core extending into the lug.

93. The method of claim 92, further comprising forming the integral lug to include at least one attachment point extending through the integral lug in a direction generally parallel to the lower face of the base, the attachment point being configured to receive a skate attachment device, to hold the skate attachment device from translational movement relative to said base.

94. The method of claim 92, wherein the integral lug is configured to interleavably engage a recess in a skate mechanism.

95. The method of claim 89, wherein the upper support is formed by joining a plurality of composite layers.

96. The method of claim 89, wherein a varying rigidity of the boot ranging from the first rigidity to the second rigidity is created by using a varying number of the layers, wherein sections of the boot having a high rigidity include a first number of the layers and sections of the boot having the low rigidity include a second number of the layers where the first number is greater than the second number.

97. The method of claim 96, wherein the varying rigidity of the boot is created by using layers including layers of varying compositions, each of the varying compositions having varying rigidities.

98. The method of claim 96, wherein the layers include at least one hingably coupled layer, the hingably coupled layer being partially joined with adjacent layers toward the base and being partially unjoined with adjacent layers away from the base such that the hingably coupled layer is movable at an upper end configured to receive the wearer's ankle.

99. The method of claim 96, wherein the layers include at least one of a long-woven fiber material.

100. The method of claim 99, wherein the long-woven fiber material includes one of a fiberglass, a carbon-fiber, and an aramid fiber.

101. The method of claim 96, further comprising an impact-resistance resistant material layered on the outermost composite layer.

102. The method of claim 101, wherein the impact-resistant material includes a polyurethane plastic.

103. The method of claim 101, wherein the layer of impact-resistant material is an outermost layer of the boot.

104. The method of claim 103, wherein the layer of impact-resistant material is transparent.

105. The method of claim 104, further comprising providing the boot with a graphical design wherein the layer of impact-resistant material is disposed to at least partially protect a graphical design disposed beneath an outer surface of the layer of impact-resistant material.

106. The method of claim 105, further comprising sublimating the graphical design on a non-outward-facing side of the layer.

107. The method of claim 96, wherein the varying rigidity of the boot is created by molding using a varying thickness wherein sections of the boot having a high rigidity include a first thickness and sections of the boot having the low rigidity include a second thickness where the first thickness is greater than the second thickness.

108. The method of claim 96, wherein the varying rigidity of the boot is created by molding using a material of varying rigidity wherein sections of the boot having a high rigidity include a first material and sections of the boot having the low rigidity include a second material where the first material is more rigid than the second material.

109. The method of claim 108, wherein at least one of the first material and the second material includes a short fiber material.

110. The method of claim 109, wherein a rigidity of the short fiber material is increasable by increasing a fiber concentration in the short fiber material.

111. The method of claim 89, further comprising extending the upper support generally over a metatarsal of the wearer's foot.

112. The method of claim 89, wherein the upper support is configured to receive a toe cap, the upper support being configured to at least partially extend over a trailing edge of the toe cap.

113. The method of claim 89, wherein the upper face of the base includes a recess for receiving an edge of a toe cap.

114. The method of claim 89, wherein at least one of the base and the upper support include a ventilation opening extending through the upper support.

115. The method of claim 89, further comprising shaping a mid region of a lower surface of the boot beneath the lower face of the base in an arch shape and a planar region adjacent the mid region.

* * * * *